US009788639B2

(12) United States Patent
Frazer et al.

(10) Patent No.: US 9,788,639 B2
(45) Date of Patent: Oct. 17, 2017

(54) PROTECTIVE HAMMOCK ENCLOSURE AND METHOD OF USE

(71) Applicants: Thomas Frazer, Scottsdale, AZ (US); Mark Gruskin, Tucson, AZ (US)

(72) Inventors: Thomas Frazer, Scottsdale, AZ (US); Mark Gruskin, Tucson, AZ (US)

(73) Assignee: Hammock Bliss, Pty Ltd., Dover Heights (AU)

( * ) Notice: Subject to any disclaimer, the term of this patent is extended or adjusted under 35 U.S.C. 154(b) by 79 days.

(21) Appl. No.: 15/008,027

(22) Filed: Jan. 27, 2016

(65) Prior Publication Data

US 2016/0213130 A1 Jul. 28, 2016

Related U.S. Application Data

(60) Provisional application No. 62/108,333, filed on Jan. 27, 2015.

(51) Int. Cl.

| | |
|---|---|
| ***A45F 3/22*** | (2006.01) |
| ***E04H 15/04*** | (2006.01) |
| ***E04H 15/32*** | (2006.01) |

(52) U.S. Cl.

CPC ..... *A45F 3/22* (2013.01); *E04H 15/04* (2013.01); *E04H 15/324* (2013.01)

(58) Field of Classification Search

CPC ..... A45F 3/22; E04H 15/04; E04H 15/324; A47C 29/003; A47C 29/006

See application file for complete search history.

(56) References Cited

U.S. PATENT DOCUMENTS

| | | | | |
|---|---|---|---|---|
| 329,763 | A | 12/1884 | Nelmes et al. | |
| 326,321 | A | 9/1885 | Nickerson | |
| 688,029 | A * | 12/1901 | Palmer | A45F 3/22 5/121 |
| 955,281 | A | 4/1910 | Norwood | |
| 961,704 | A * | 6/1910 | Mark | A45F 3/22 5/121 |
| 1,081,481 | A | 12/1913 | Avery et al. | |
| 1,116,074 | A | 11/1914 | Jones | |

(Continued)

FOREIGN PATENT DOCUMENTS

| | | |
|---|---|---|
| DE | 19740849 | 3/1999 |
| WO | 9857567 | 12/1998 |
| WO | 0204767 | 1/2002 |

*Primary Examiner* — Eric Kurilla

(74) *Attorney, Agent, or Firm* — Gearhart Law LLC

(57) ABSTRACT

A hammock enclosure designed for preferably one or two hammocks can be used in a variety of settings and locales due to a number of features of the enclosure. The hammock enclosure has sides made of a high quality netting to prevent insects from entering the enclosure. Additionally, an adjustable, water proof rain fly is positioned above the enclosure and the bottom of the enclosure also comprises a water proof material. The hammock enclosure is affixed, preferably to two trees, and the hammocks then hung inside. The lines for the hammocks pass through openings which may be cinched close to again prevent water, insects, and the like from entering the enclosure. Alternatively, the hammock enclosure may be secured to the ground via loops, an upper loop(s), and a securement mechanism. This enables the hammock enclosure to be utilized as a traditional ground shelter.

20 Claims, 6 Drawing Sheets

(56) References Cited

U.S. PATENT DOCUMENTS

| | | | | |
|---|---|---|---|---|
| 1,138,210 | A | 5/1915 | Gordon | |
| 1,145,290 | A | 7/1915 | Bradshaw | |
| 1,209,479 | A | 12/1916 | Nesom et al. | |
| 1,559,303 | A | 10/1925 | Bates | |
| 1,961,915 | A * | 6/1934 | Salmen, Jr. | E04H 15/324 135/143 |
| 4,071,917 | A | 2/1978 | Mojica | |
| 5,072,465 | A | 12/1991 | Lyons, Jr. | |
| 5,240,021 | A * | 8/1993 | Snodgrass | E04H 15/324 135/116 |
| 5,913,772 | A | 6/1999 | Clark | |
| D414,957 | S | 10/1999 | Rajacich | |
| 6,085,767 | A * | 7/2000 | Maslow | E04H 15/04 135/121 |
| 6,421,851 | B2 | 7/2002 | Hennessy | |
| 7,699,068 | B2 | 4/2010 | Helsdon | |
| 8,161,991 | B2 | 4/2012 | Johnson | |
| 8,491,053 | B2 | 7/2013 | Stringer | |
| 9,314,090 | B1 * | 4/2016 | Manning | A45F 3/22 |
| 2005/0188460 | A1 * | 9/2005 | O'Brien | A45F 3/22 5/121 |
| 2008/0072944 | A1 * | 3/2008 | Wu | A45F 3/22 135/90 |
| 2008/0302403 | A1 * | 12/2008 | Stewart | E04H 15/04 135/114 |
| 2009/0265851 | A1 * | 10/2009 | Clark | A45F 3/22 5/122 |
| 2011/0017251 | A1 * | 1/2011 | Overbaugh | E04H 15/001 135/90 |
| 2014/0158174 | A1 * | 6/2014 | Rhett, Jr. | E04H 15/34 135/121 |

* cited by examiner

PROTECTIVE HAMMOCK ENCLOSURE AND METHOD OF USE

CLAIM OF PRIORITY

This application claims priority to U.S. Application Ser. No. 62/108,333 filed on Jan. 27, 2015, the contents of which are fully incorporated herein by reference in its entirety.

FIELD OF THE EMBODIMENTS

The present invention and its embodiments relate to sleeping apparatuses, namely enclosures for hammocks. In particular, the present invention is an enclosure for multiple hammocks that protects one from the elements and nuisance animals such as insects.

BACKGROUND OF THE EMBODIMENTS

A hammock is a sling made of rope, fabric, netting, or the like that is suspended between and attached to two points. Hammocks were originally used in Central American and South America, but have advanced with the times, and are now prevalent worldwide in today's society. Hammocks typically come in two styles: 1) those for leisure users and 2) those for outdoor enthusiasts. The hammocks built for the "outdoor enthusiast" combine the use of modern technology including netting, protection from the elements (i.e. wind, rain, etc.), and lightweight materials. However, even with these modern advances, the current hammocks still leave much to be desired.

Often, hammocks have limited protection from the elements and nuisance animals. This means that insects and the like can intrude on a person or persons when they are attempting to relax or sleep in a hammock. Additionally, the protection from wind and rain may not be easily adjusted to compensate for directional shifts, requiring an individual to exit the hammock to make the necessary adjustments thereby subjecting them to the elements. Alternatively, the weather may be such that it precludes the use of a hammock altogether. Further, those that do contain some form of protection, this protection is permanently adhered to the structure and is usually cumbersome to manipulate.

Thus, there is a need for an enclosure for a hammock(s) that protects one from the elements and increases the comfort level of a hammock user. Further, such an enclosure should enable multiple users to comfortably share the same space.

REVIEW OF RELATED TECHNOLOGY

U.S. Pat. No. 8,491,053 pertains to a camouflage hunting blind system comprising a hanger with a distal and a proximate end, the proximate end of the hanger comprises an S-hook for suspending a hammock chair which is then cloaked within a camouflaged covering. The distal end of the hanger is positioned against tree with the proximate end pointing upward and away from the tree at a 45 degree angle wherein both ends are secured using a tether. The camouflage hunting blind system is positioned so a user's feet may touch the ground to rotate hammock chair for (through) 360 degrees of view. The hammock chair may be reversible, having a first side with natural (nature camouflage) colorings and a second side with hunter orange or other suitable coloring (dark or other.) Camouflage hunting blind system may have a camouflage coloring on the outside and a dark coloring on the inside, and weigh less than 10 lbs., and sets up in a very short time. Camouflaged covering encapsulates hammock chair, concealing scent and providing warmth for its user(s).

U.S. Pat. No. 329,763 pertains to a hammock which is encased by a slidable screen connected to an overhead wire or rope. Two hoops prevent the slidable screen from collapsing on the hammock's occupant.

U.S. Pat. No. 326,321 pertains to a hammock with a frame that supports a mosquito net. The net entirely envelops the hammock and part of which forms a door for a user to enter or leave the enclosed space. The netting is supported by hoops located towards either end of the hammock.

Various devices are known in the art. However, their structure and means of operation are substantially different from the present disclosure. In turn, the other inventions fail to solve all the problems taught by the present disclosure. The present invention and its embodiments provide for a camping enclosure that can be used as either a suspended hammock enclosure or a ground shelter directly secured to the ground. The camping enclosure is intended to be waterproof and insect resistant. At least one embodiment of this invention is presented in the drawings below and will be described in more detail herein.

SUMMARY OF THE EMBODIMENTS

The present invention and its embodiments relate to a camping enclosure which can serve as both a suspended hammock enclosure and a traditional ground shelter resting directly upon the ground. The inventor has found a strong need for such an enclosure to support the requirements of the burgeoning camping/outdoor community. When used as a ground shelter, external loops located on the top and bottom of the enclosure provide functional areas for a securement mechanism such as a pole to be attached thereto. This permits the enclosure to remain upright, sturdy, and functional when used as a traditional ground shelter.

When a user desires to use the camping enclosure as a suspended hammock enclosure, the enclosure is suspended between at least two securement points where various support lines and ridgelines may be attached thereto. Once suspended, hammocks can then be suspended therein preferably using the same support or securement points as the enclosure lines. Closeable or cinchable ports allow the hammock lines to pass through the enclosure and then be closed to prevent the entry of insects, water, and the like. Multiple hammocks may be able to be suspended from within the enclosure at the same time.

In one embodiment there is a camping enclosure having an enclosure body with a front side, a back side, a first end and a second end, wherein the enclosure body has a resealable door, and wherein the enclosure body comprises a mesh netting; a first water proof barrier positioned above and coupled to the enclosure body; and a second water proof barrier positioned at a bottom of and coupled to the enclosure body, wherein the second water proof barrier is rectangular in shape and has loops positioned and coupled thereto at each vertex of the second water proof barrier.

In another embodiment, there is a hammock enclosure for at least two hammocks is described and taught having an enclosure body having a front side, a back side, a first end and a second end, the enclosure body being sized to envelop the at least two hammocks, wherein the enclosure body has a resealable door, and wherein there is at least one port on each of the first end and the second end of the enclosure body; a first water proof barrier positioned above and coupled to the enclosure body; a second water proof barrier positioned at a bottom of the enclosure body; and a ridgeline, wherein the ridgeline extends from a first support to a second support and holds the enclosure body in an elevated position.

In another embodiment of the present invention there is a hammock enclosure for one or two hammocks having an enclosure body with a front side, a back side, a first end and a second end defining an interior, the enclosure body being sized to envelop the at least two hammocks, wherein the enclosure body has a length of a teeth and groove fastener thereby providing access to the interior of the enclosure body, and wherein there are at least two resizable ports on each of the first end and the second end of the enclosure body; a first water proof barrier positioned above and coupled to the enclosure body, wherein a position the first water proof barrier is adjustable; a second water proof barrier positioned at a bottom of the enclosure body; and a ridgeline, wherein the ridgeline is a length of material that extends from a first support to a second support and holds the enclosure body in an elevated position relative to the ground level.

In another aspect of the invention there is a method of securing at least two hammocks in a hammock enclosure, the method having the steps of: affixing both ends of a ridgeline of the hammock enclosure to at least one secondary object with each end being attached to a separate secondary object; inserting lines for a first hammock through first holes located in a first end and a second end of the hammock enclosure; affixing a first line and a second line of the first hammock to the at least one secondary object; inserting lines for a second hammock through second holes located in the first end and the second end of the hammock enclosure; affixing a first line and a second line of the second hammock to the at least one secondary object; and cinching the first holes and the second holes around the lines of the first hammock and the second hammock.

Generally, the hammock enclosure encloses at least two hammocks. The hammock enclosure is intended to be hung or suspended between two trees or other suitable supporting elements. Once positioned, the support lines for the hammocks can be threaded through openings (ports) in the end of the enclosure and connected to the same or different supporting element. The position of the hammocks can then be adjusted, by height and tension, and contained therein. The hammock enclosure has a rain fly or water proof barrier positioned above and coupled to the enclosure. The rain fly is further adjustable and can be secured in position using lines coupled to the vertices of the rain fly.

The enclosure itself is by and large comprised of insect barrier netting and in some embodiments the netting used is commonly known as no-see-um mesh. This particular netting has a plurality of interlocking diamonds. The netting employed, regardless of type, preferably has at least 2000 holes per square inch more preferably has 2100 holes per square inch. The bottom portion of the enclosure is water proof as well and permits items to be stored on the bottom as the hammocks are suspended in the interior of the enclosure. When not in use, the hammock enclosure can be rolled up and stored in a storage bag which is secured with a cord and stopper for easy transportation and storage.

In general, the present invention succeeds in conferring the following, and others not mentioned, benefits and objectives.

It is an object of the present invention to provide a hammock enclosure that accommodates more than one hammock.

It is an object of the present invention to provide a hammock enclosure that protects users from being bitten or otherwise annoyed by bugs.

It is an object of the present invention to provide a hammock enclosure that keeps users dry and otherwise aids in protecting them against the elements.

It is an object of the present invention to provide a hammock enclosure that provides easy access in and out of the enclosure.

It is another object of the present invention to provide a hammock enclosure that is lightweight and resilient.

It is another object of the present invention to provide a hammock enclosure that may be used with a suspended hammock.

It is another object of the present invention to provide a hammock enclosure that can store gear for hiking, fishing, camping, climbing, and the like.

It is another object of the present invention to provide a hammock enclosure that helps to retain the body heat of the users.

It is another object of the present invention to provide a hammock enclosure that is versatile and easy to set up and tear down.

It is another object of the present invention to provide a hammock enclosure that can be used as both as suspended hammock enclosure and a ground based shelter.

DESCRIPTION OF THE PREFERRED EMBODIMENTS

Figure 1A:
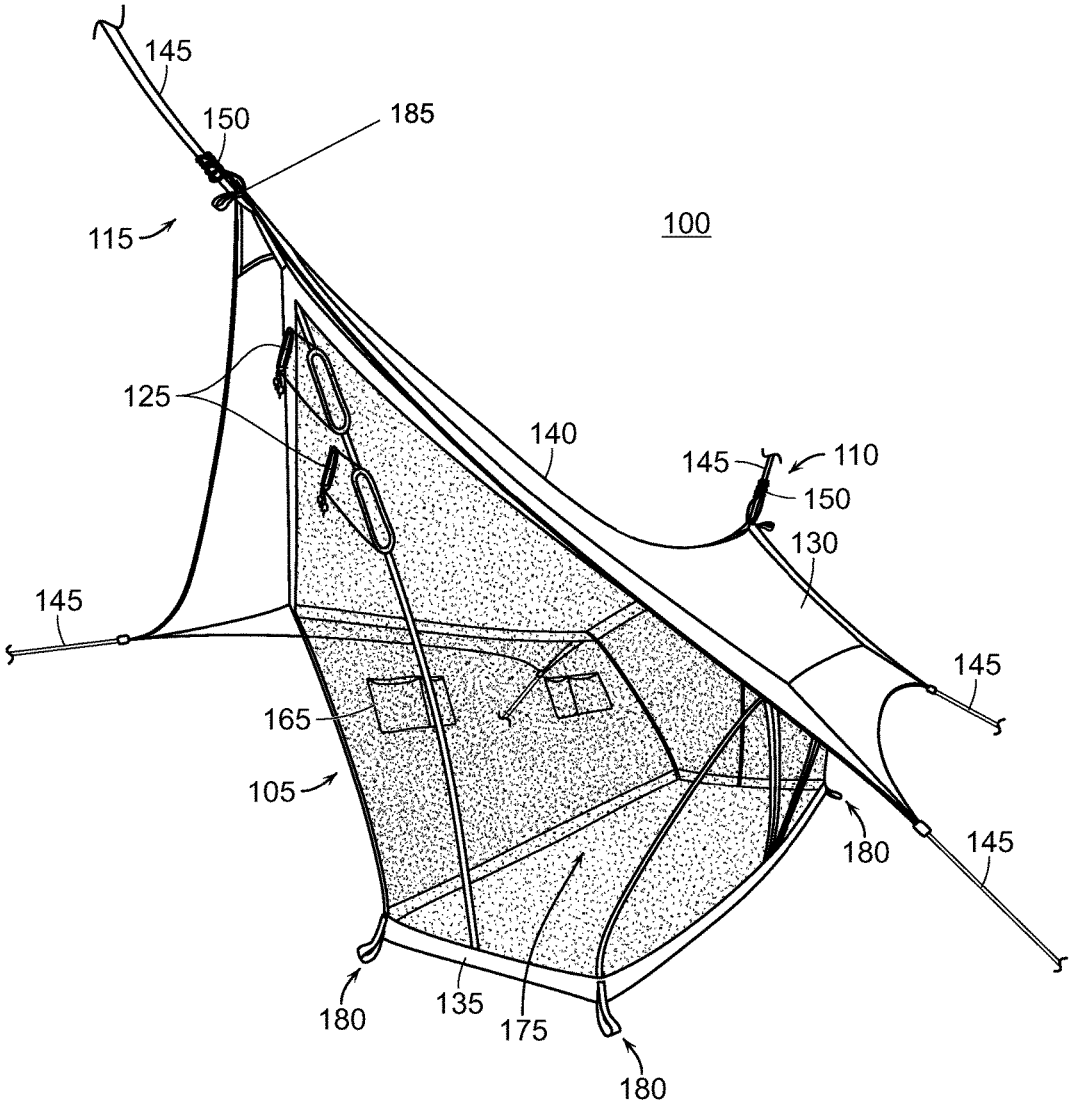
FIG. 1A is a first perspective view of the hammock enclosure without hammocks contained therein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
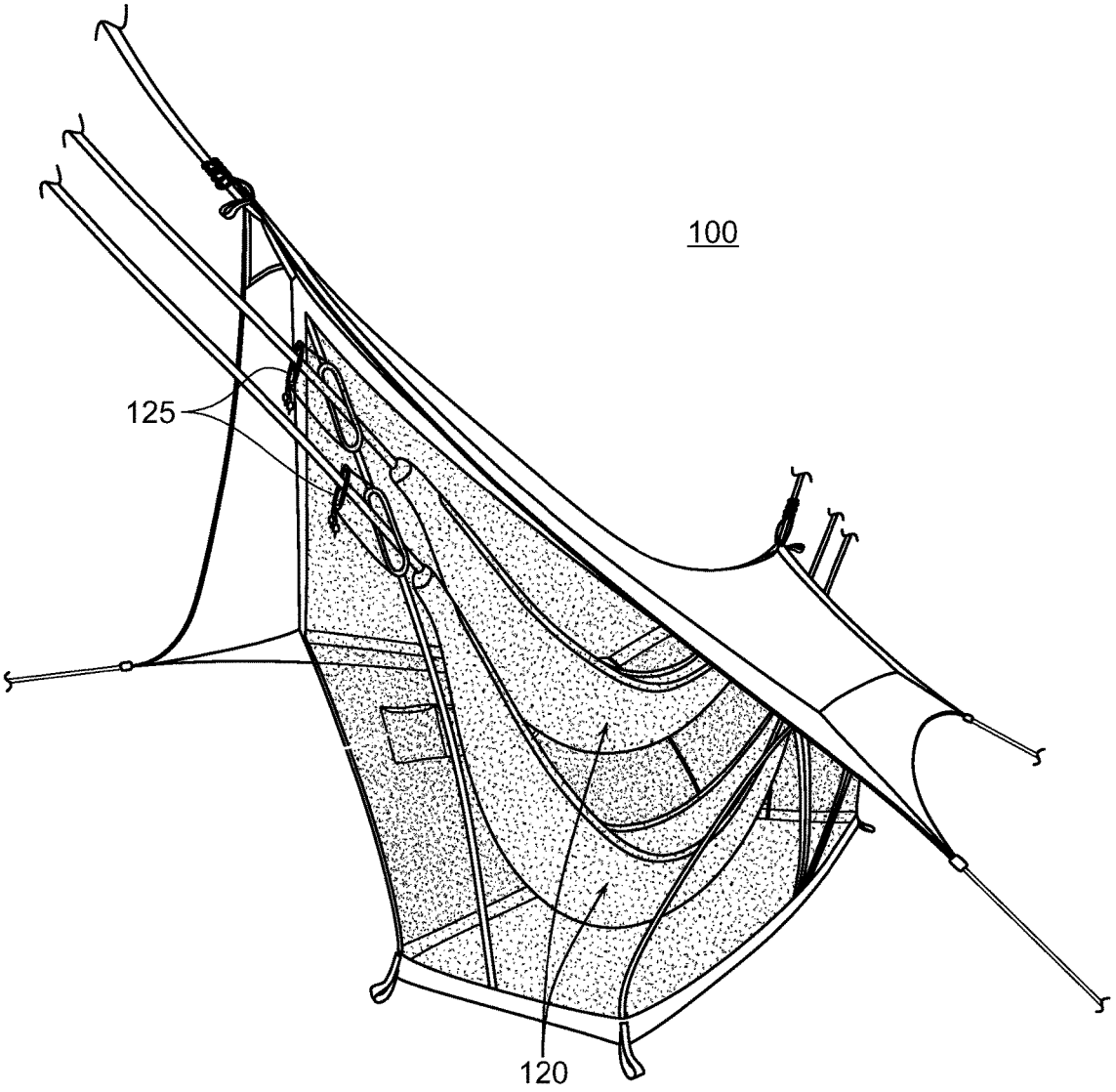
FIG. 1B is a first perspective view of the hammock enclosure with hammocks contained therein.
Figure 2:
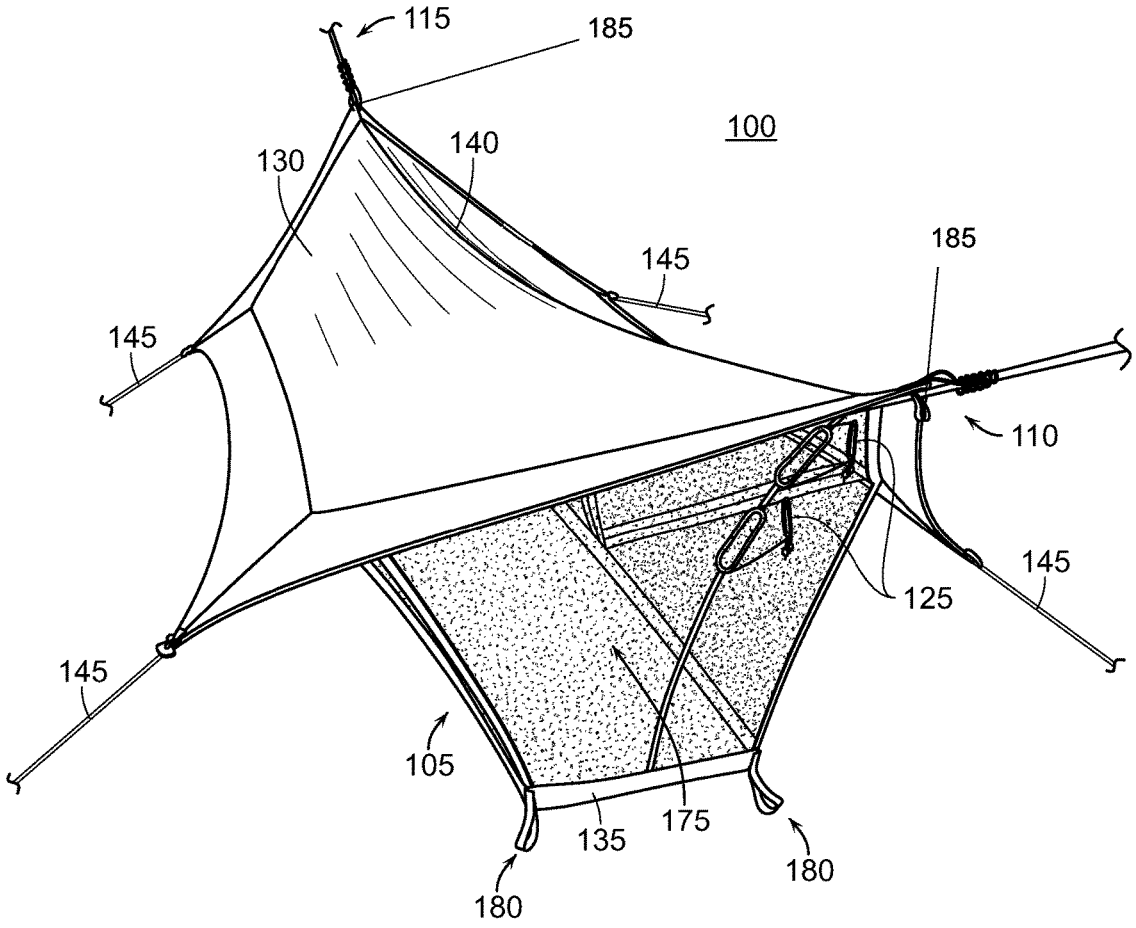
FIG. 2 is a second perspective view of the hammock enclosure.

Generally, the present invention and its embodiments provides for a camping enclosure that can be used as either a suspended enclosure or a ground shelter. Referring now to FIGS. 1A, 1B, and 2, there are multiple perspective views of one embodiment of the present invention. The hammock enclosure 100 is positioned and preferably suspended from two secondary objects. In this instance, the secondary objects may be trees or parts thereof. However, the secondary objects may be a wide variety of items including but not limited to poles, foundations, rocks, columns, and the like or any combination thereof.

The hammock enclosure 100 is supported between the secondary objects by a ridgeline 140. The ridgeline 140 is a length of material, preferably climbing rope, having a diameter of at least 4 mm and more preferably at least 6 mm and is at least 5 m in length and more preferably about 7.5 m in length. The ridgeline 140 supports the hammock enclosure 100 and the first water proof barrier or rain fly 130.

The rain fly 130 is coupled to the ridgeline 140 via at least two attachment points 150 preferably using Prusik knots which allow for the rainfly 130 to be adjusted quickly and easily. Using such a knot also enables easy tensioning of the ridgeline and the ridgeline can subsequently be moved to either end of enclosure by way of the Prusik knot. The rain fly 130 is comprised of a water proof polyurethane coasted material that further has a number of vertices which may be used as points of attachment for the rain fly 130. There may be additional points of attachment on the rain fly 130 or the hammock enclosure 100 that enables a rain fly extension to be coupled thereto thereby increasing the size of the rain fly 130.

A length of material 145 may emanate from the vertices or attachment points of the rain fly 130, as noted above. This length of material 145 may vary but is preferably rope, yarn, twine, or the like or any combination thereof that can be used to maintain the position of the rain fly 130 by attaching to a securement point. The length of material 145 preferably measures at least 2.5 m from each attachment point to a terminal end in order to provide adequate versatility in positioning of the rain fly 130. Further, the length of material 145 has a number of buckles, fasteners, or the like to adjust the tension in each of the lengths of material 145. For example, the length of material 145 may be coupled to an anchor(s) in the ground. This anchor will prevent the rain fly 130 from shifting thereby keeping the occupants of the hammock enclosure 100 dry. In other instances, the length of material 145 may be secured to a pole or tree or other appropriate structure to secure the desired position of the rain fly 130.

The hammock enclosure 100 is suspended below the rain fly 130 and has a front side, a back side, sides, and a bottom. The front side, back side, and sides comprise the main area of the hammock enclosure 100. At least the front side and the back side of the hammock enclosure 100 comprises a mesh netting 175 designed to prevent insects, water and the like, from entering the enclosure. Preferably all vertically situated sides of the hammock enclosure 100 employs this mesh netting, and in some embodiments the top and bottom also comprise a mesh netting 175. The mesh netting 175 preferably has at least 2000 holes per square inch and more preferably has at least 2100 holes per square inch.

The base layer or bottom 135 is preferably comprised of a second water proof barrier which is preferably a water proof, light weight rip stop nylon. This layer may extend as far as about 7.6 cm upwards from the bottom of the hammock enclosure 100 to prevent water from entering the enclosure if the bottom 135 is touching the ground. The bottom 135 is further selected to help retain body heat of the occupants while providing excess space or storage or drying of items as the hammocks are suspended within the enclosure.

Additionally, at the vertices of the bottom 135 there are loops 180. These loops 180 are intended to provide a mechanism by which the hammock enclosure 100 can be secured to the ground and used as a ground shelter. Upper loops 185 are further employed in such an intended usage. These upper loops 185 allow for a coupling to a camping pole or the like to further secure the hammock enclosure 100 when used as a ground shelter, while the loops 180 can have stakes or camping poles or the like inserted through the loops 180 and into the ground thereby securing the enclosure.

A pocket 165 for storage may be coupled to the hammock enclosure 100 in a variety of positions around the interior and/or exterior surface of the hammock enclosure 100. This gives the user(s) additional storage for gear, food, and the like if need be. Further, the pocket(s) 165, in some embodiments, is sized such that the hammock enclosure 100 can be collapsed and folded into the pocket 165. This provides for easy storage and transportation when the hammock enclosure 100 is not in use.

The hammock enclosure 100 provides space for preferably one and/or two hammocks and in some embodiments may be sized to provide for three or more hammocks. As shown in FIG. 1B, the hammocks 120 are positioned within the hammock enclosure 100 with one hammock 120 being substantially positioned over another hammock 120. It may be preferable to have the lighter of the two users (in terms of weight) to occupy the top or upper hammock 120 to prevent undue sagging of the hammock 120. The two users or any one user may be able to position themselves in any orientation that is one user with their head towards the first end 105 and one user with their head towards the second end 110, or with both users having their heads facing one end or the other.

The hammocks 120 may be positioned within the hammock enclosure 100 once the hammock enclosure 100 has been suspended or otherwise positioned for use. The lines for securing the hammocks pass through ports 125 in both the first end 110 and the second end 115 of the hammock enclosure 100. The ports 125 are cinchable and can be closed around the hammock lines to create substantially sealed interior.

The first water proof barrier or rainfly 130 is positioned in a way that enables access to the hammock enclosure 100, but still protects the users from the elements whether it be wind, rain, temperature, etc. The rain fly 130 can further be manipulated as need be to conform to shifts in weather (i.e. change in direction of the wind) or to prevent direct sunlight from entering the hammock enclosure 100.

Figure 3:
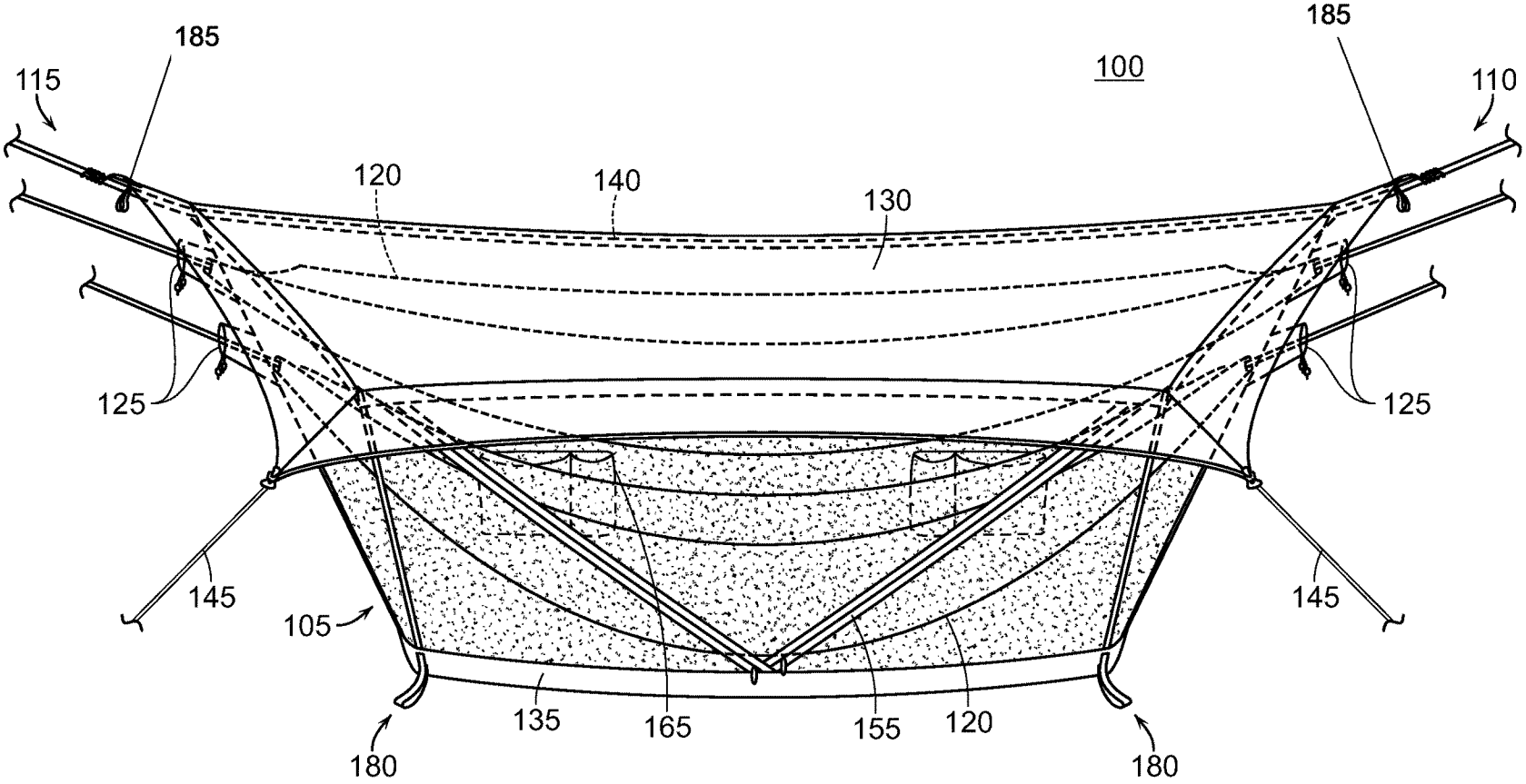
FIG. 3 is a side view of the hammock enclosure with two hammocks suspended therein.

FIG. 3 shows the hammock enclosure 100 from a side view providing a different perspective on the interaction of the components of the hammock enclosure 100. The ridgeline 140 is again suspended between at least two secondary objects. The lines leading from the first end 110 and the second end 115 of the hammock enclosure 100 are used in the suspension of the hammock enclosure 100. The rain fly 130 is coupled thereto and positioned using a length of material 145.

The hammock enclosure 100 has a resealable door 155 preferably using a teeth and groove fastener, such as a zipper, to supply the fastening mechanism of the door. The resealable door 155 preferably bears a V or U shape and spans approximately the length of the hammock enclosure. On the inside, or interior, of the hammock enclosure 100 there may be any number of attachment mechanisms that allow the door to be rolled up or otherwise positioned and secured thereto. This provides easy access in or out of the hammock enclosure 100 and additionally allows the netting 175 to be temporarily removed from someone's face thereby increasing the sun and breeze felt by the user.

A number of pockets 165 may be disposed along the interior of the hammock enclosure 100 to hold any number or type of lightweight items. Preferably, the pockets 165 are secured to the hammock enclosure 100 and formed of the same mesh netting as described above. The pockets 165 may have a loose flap to help secure the contents of the pocket 165. In other embodiments, the pockets 165 may be detachable or repositionable, via an attachment mechanism such as a hook and loop fastener, as needed. The pockets 165 may further be sealed with a securement mechanism such as a teeth and groove fastener.

The bottom 135 of the hammock enclosure 100 is generally as described as in FIGS. 1 and 2. Further, the bottom 135 is preferably rectangular in shape and has a loop 180 at each of the four vertices. These loops 180 are beneficial for securement of the hammock enclosure 100 when it is desired to be used as a ground shelter. The inventors have identified a strong need for not only a hammock enclosure 100, but also a hammock enclosure 100 which can further be used as a ground shelter. This enhanced flexibility gives users the option to use the suspended hammock enclosure 100 to secure their suspended hammocks or to secure the hammock enclosure 100 to the ground to be used as a traditional ground shelter along the lines of a tent.

To further support the use of the hammock enclosure 100 as a ground shelter, there are upper loops 185 for additional securement purposes. A securement mechanism such as a hiking pole or camping pole or the like or any combination thereof. These loops 180 and the upper loops 185 can be utilized in conjunction with the securement mechanism to allow the hammock enclosure to remain upright and functional when placed and secured to the ground.

As shown, the hammocks 120 are positioned within the hammock enclosure 100 with one hammock 120 being substantially positioned over another hammock 120. It may be preferable to have the lighter of the two users (in terms of weight) to occupy the top or upper hammock 120 to prevent undue sagging of the hammock 120. The two users or any one user may be able to position themselves in any orientation that is one user with their head towards the first end 105 and one user with their head towards the second end 110, or with both users having their heads facing one end or the other.

Figure 4:
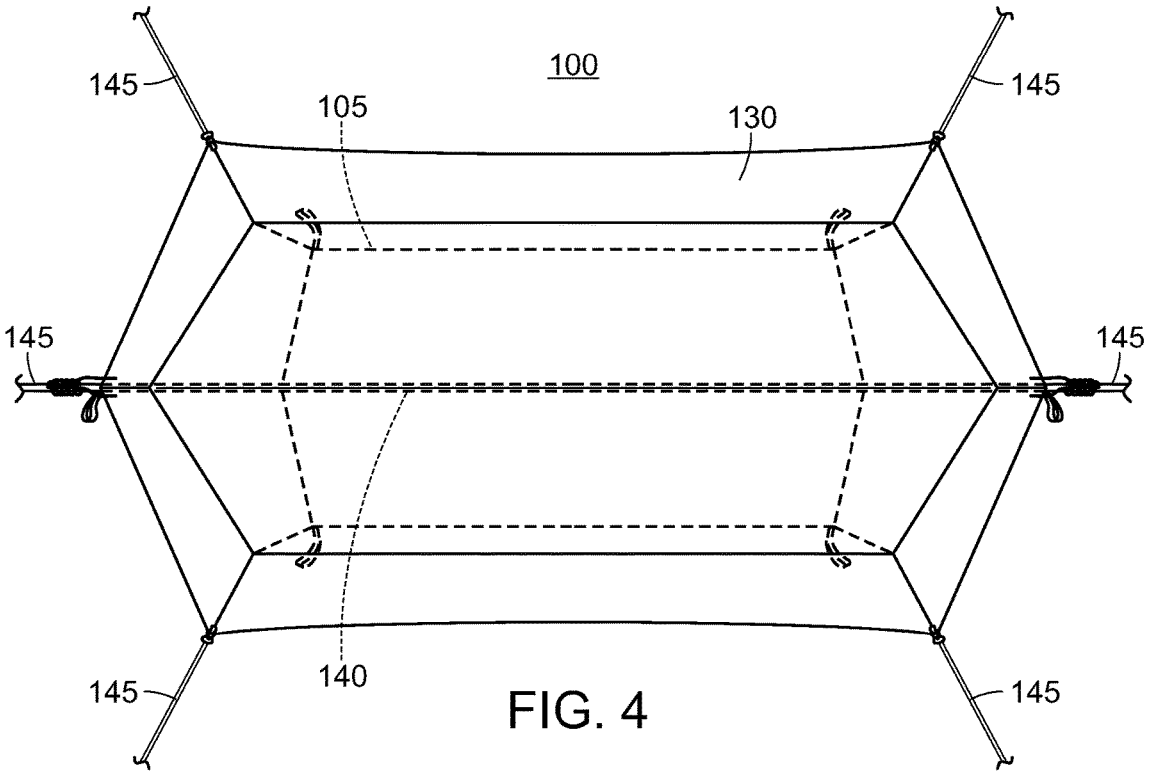
FIG. 4 is a top view of the hammock enclosure.

In FIG. 4, there is a top view of the hammock enclosure 100. The rain fly or first waterproof barrier 130 is shown in position above the hammock enclosure 100. The enclosure body 105 resides therebelow protected underneath the rain fly 130. A length of material 145 stems from a number of points along the rain fly 130. Preferably, these lengths are located at each of the vertices of the rain fly 130 but may be situated at any point along the perimeter of the rain fly 130. The ridgeline is shown traversing the length of the hammock enclosure 100 thereby supporting the hammock enclosure 100 as a whole.

The rain fly 130 may take any number of shapes and sizes to adequately protect those inside from the elements. In some embodiments, the rain fly 130 may have attachment points for additional material to be added thereto to provide additional protection against wind, rain, sun, and the like. The length of material 145 may be attached to objects such as trees, poles, ground anchors, and the like or any combination thereof.

Figure 5:
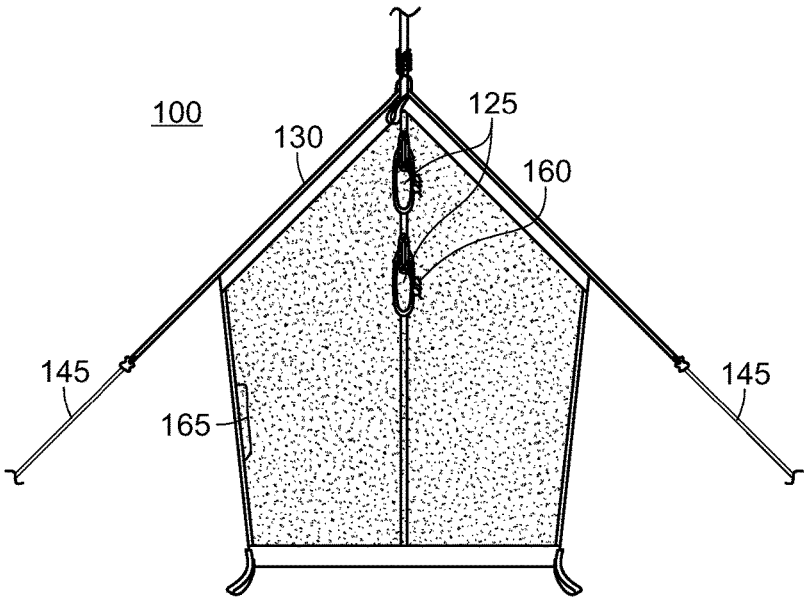
FIG. 5 is a side view of one side of the hammock enclosure showing the cinchable port.

Referring now to FIG. 5, the hammock enclosure 100 is shown with a view out one of the ends of the hammock enclosure 100. The netting 175 of the hammock enclosure 100 is shown substantially covering the exterior of the hammock enclosure 100. The rain fly 130 is positioned such that it covers part of the hammock enclosure 100 and primarily the area most prone to receiving rain or other materials falling thereupon.

At this end of the hammock enclosure 100 there is a port 125 that is generally an opening in the end of the hammock enclosure 100. The diameter of the port 125 can be manipulated via the closure mechanism 160.

In order to position a hammock in the hammock enclosure 100, the port 125 must be widened enough to allow the hammock lines therethrough. Preferably, the port 125 can expand or contract to have a diameter of about 1.3 cm to about 13 cm. Once the port 125 has been adjusted to accommodate the hammock lines, the lines are fed through the port 125 and to the exterior of the hammock enclosure 100. The hammock lines can then be secured to a secondary object thereby securing the position of the hammock. The closure mechanism 160 is then used to cinch the port 125 closed around the hammock lines. This effectively closes off the environment outside of that hammock enclosure 100 from that inside the hammock enclosure 100. The user can then rest comfortably knowing that insects and environmental material such as dust and rain will remain outside the enclosure.

Figure 6:
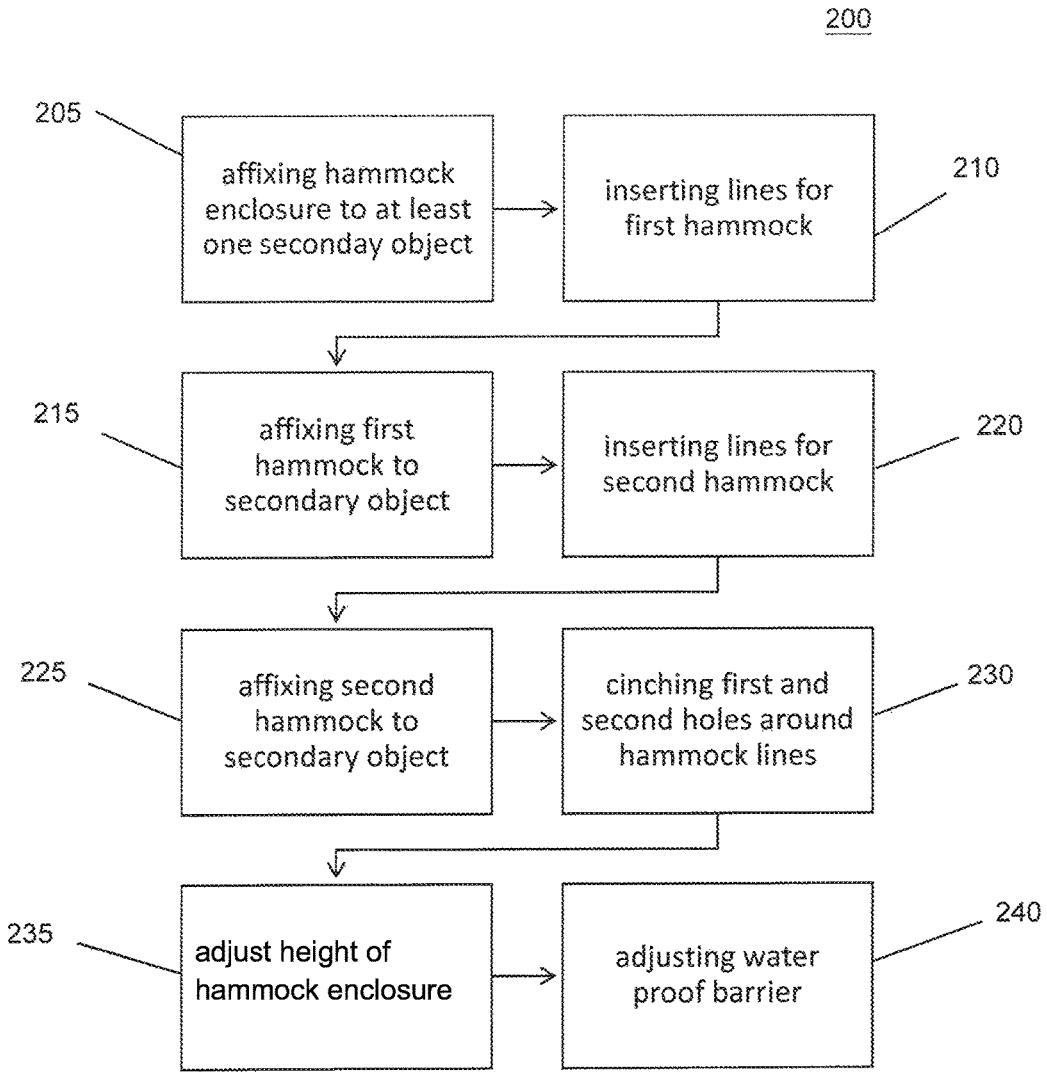
FIG. 6 is a flow chart illustrating a method of use of an embodiment of the present invention.

In FIG. 6, there is a method 200 of using the hammock enclosure as described above. The hammock enclosure may generally be used for a variety of purposes including storage of gear and providing a place for rest.

In step 205, one must affix the hammock enclosure to a secondary object. This involves locating a suitable pair of objects that will support the hammock enclosure and its contents. The secondary objects, such as trees or support posts, should be about 1.5 m to about 4.5 m apart and more preferably about 3.9 m apart.

In step 210, the lines for the first hammock are inserted through a port in either end of the hammock enclosure. If only one hammock is to be hung within the enclosure, it may be preferable to use the upper ports for the hammock lines. In this instance, the lower ports may provide an increase in the airflow and comfort to the user of the single hammock. If two hammocks are desired to be hung in the hammock enclosure, the lower ports should preferably be employed for securing the lines of the first hammock. Then, when the second hammock is to be positioned and hung, the already used lower ports will provide clear and unobstructed access to the upper ports.

In step 215, the lines for the first hammock are affixed to a secondary object. The hammock lines coming from the lower of the two sets of ports should be affixed to the secondary object (i.e. tree) below the ridgeline of the hammock enclosure. Preferably the hammock is height adjusted so that it is suspended about 15 cm to about 30 cm above the hammock enclosure floor or bottom.

In step 220, the lines for the second hammock, if being used, are inserted through the upper set of ports.

In step 225, these lines should be affixed to the secondary object above the ridgeline of the hammock enclosure. The hammock is preferably positioned about 0.5 m above the lower of the two hammocks. For both of the hammocks, it is preferable that each hammock have about 30° of slack respective to the ridgeline once affixed and secured. This angle will provide the ideal comfort level to the user as well as maximize the space provided to each of the users within the hammock enclosure.

In step 230, the ports around the hammock lines are closed using the closure mechanism to cinch the ports shut around the hammock lines preventing insects and water from entering the hammock enclosure. This may be done in a variety a manner but preferably uses a drawstring with a fastening mechanism to stabilize the position of the drawstring.

In step 235, the height of the hammock enclosure may optionally be adjusted if one has not already done so. This may be done when it is apparent the weight of the users and their items inside the hammock enclosure are causing undue sag or putting strain on the hammock enclosure. Preferably, the height of the hammock enclosure is about adjusted so that the height of the top of the hammock enclosure is about 1.5 m (5 feet) to about 2 m (6.5 feet) above ground level.

In step 240, the water proof barrier or rain fly is adjusted. There are a number of adjustment mechanisms on each of the corners or vertices of the rain fly. The length of material, preferably a length of rope, can then be affixed to a stake, rock, tree, or the like or any combination thereof. This process is repeated for each of the lengths of material.

A knot near the end of the cord can then be pulled to adjust the adjustment mechanism thereby increasing the tension in the length of material. To release the tension, one manipulates the adjustment mechanism and releases the length of material from its previously fixed position. The users and any supplies they may have can then use the hammock enclosure for rest and relaxation.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A camping enclosure comprising;

an enclosure body having a front side, a back side, a first end, a second end, and a length extending from the first end to the second end, wherein the enclosure body has a resealable door, and wherein the enclosure body comprises a mesh netting;

a first water proof barrier positioned above and coupled to the enclosure body; and a second water proof barrier positioned at a bottom of and coupled to the enclosure body, wherein the second water proof barrier is rectangular in shape and has lower loops positioned and coupled thereto at each vertex of the second water proof barrier;

wherein the resealable door comprises a teeth and groove fastener extending along the front side, the teeth and groove fastener comprising a first portion spanning from approximately the first end to the bottom of the enclosure body and a second portion spanning from approximately the bottom of the enclosure body to the second end, the first portion and the second portion cooperatively spanning approximately the length of the enclosure body.

2. The camping enclosure of claim 1 further comprising at least one securement mechanism for securing the camping enclosure to a position on the ground.

3. The camping enclosure of claim 2 wherein the securement mechanism is coupled to any upper loops, any of the lower loops, or any combination thereof.

4. The camping enclosure of claim 1 further comprising a ridgeline, wherein the ridgeline extends from at least a first support to a second support and holds the enclosure body in an elevated position.

5. The camping enclosure of claim 4 wherein the enclosure body has at least two ports with one port being on each of the first end and the second end of the enclosure body.

6. The camping enclosure of claim 5 wherein at least one hammock is positioned and suspended within the enclosure body.

7. The camping enclosure of claim 6 wherein there are two hammocks positioned and suspended in the hammock enclosure at differing heights.

8. A hammock enclosure for two hammocks comprising:

an enclosure body having a front side, a back side, a first end, a second end, and a length extending from the first end to the second end, the enclosure body being sized to envelop the two hammocks, wherein the enclosure body has a resealable door, and wherein there is at least one port on each of the first end and the second end of the enclosure body;

a first water proof barrier positioned above and coupled to the enclosure body;

a second water proof barrier that is polygonal in shape and is positioned at a bottom of the enclosure body; and a ridgeline, wherein the ridgeline extends from at least a first support to a second support and holds the enclosure body in an elevated position;

wherein the resealable door comprises a teeth and groove fastener extending along the front side, the teeth and groove fastener comprising a first portion spanning from approximately the first end to the second water proof barrier and a second portion spanning from approximately the second water proof barrier to the second end, the first portion and the second portion cooperatively spanning approximately the length of the enclosure body.

9. The hammock enclosure of claim 8 further comprising at least one loop coupled to each vertex of the second water proof barrier.

10. The hammock enclosure of claim 8 wherein the at least one port has a closure mechanism that changes a width of an opening of the at least one port.

11. The hammock enclosure of claim 8 wherein at least the front side and the back side comprise a mesh netting.

12. The hammock enclosure of claim 8 further comprising at least one pocket coupled to the hammock enclosure.

13. The hammock enclosure of claim 8 further comprising a length of material for securing the hammock enclosure to at least two secondary objects.

14. The hammock enclosure of claim 8 wherein a position of the first waterproof barrier is adjustable.

15. The hammock enclosure of claim 8 further comprising at least one upper loop.

16. A hammock enclosure for two hammocks comprising:

an enclosure body having a front side, a back side, a first end, and a second end defining an interior, the enclosure body also having a length extending from the first end to the second end, the enclosure body being sized to envelop the two hammocks, wherein the enclosure body has a teeth and groove fastener extending along the front side thereby providing access to the interior of the enclosure body, and wherein there are at least two resizable ports on each of the first end and the second end of the enclosure body;

a first water proof barrier that is polygonal in shape and is positioned above and coupled to the enclosure body, wherein a position of the first water proof barrier is adjustable;

a second water proof barrier positioned at a bottom of the enclosure body;

the teeth and groove fastener comprising a first portion spanning from approximately the first end to the second water proof barrier and a second portion spanning from approximately the second water proof barrier to the second end, the first portion and the second portion cooperatively spanning approximately the length of the enclosure body;

and a ridgeline, wherein the ridgeline is a length of material that extends from a first support to a second support and holds the enclosure body in an elevated position relative to the ground level.

17. The hammock enclosure of claim 16 wherein the two hammocks are positioned at differing heights in the hammock enclosure.

18. The hammock enclosure of claim 16 wherein the first water proof barrier has a length of material extending from each vertex of the first water proof barrier.

19. The hammock enclosure of claim 18 wherein the length of material of the first water proof barrier is capable of being coupled to a securement point.

20. The hammock enclosure of claim 16 wherein the front side and the back side comprise a netting having at least 2000 holes per square inch.

* * * * *